US010934726B2

(12) United States Patent
Elduayen Madariaga et al.

(10) Patent No.: US 10,934,726 B2
(45) Date of Patent: Mar. 2, 2021

(54) EXTRACTOR FOR EXTRACTING CONICAL SPACERS IN CONCRETE WALLS OR PILLARS AND ASSOCIATED METHOD

(71) Applicants: 20 EMMA 20 S.L., Aduna (ES); HEGAIN 2100 CONSULTING S.L., Irun (ES)

(72) Inventors: Juan Andrés Elduayen Madariaga, Aduna (ES); Javier Sanchez Garduño, Irun (ES)

(73) Assignee: 20 EMMA 20 S.L., Irun (ES)

( * ) Notice: Subject to any disclaimer, the term of this patent is extended or adjusted under 35 U.S.C. 154(b) by 329 days.

(21) Appl. No.: 15/952,763

(22) Filed: Apr. 13, 2018

(65) Prior Publication Data

US 2018/0230702 A1 Aug. 16, 2018

Related U.S. Application Data

(63) Continuation of application No. PCT/ES2015/070757, filed on Oct. 20, 2015.

(51) Int. Cl.
*B23P 19/02* (2006.01)
*E04G 17/06* (2006.01)

(52) U.S. Cl.
CPC ..... *E04G 17/0642* (2013.01)

(58) Field of Classification Search
CPC ..... B23Q 1/25; E04G 17/06; B25D 1/00
See application file for complete search history.

(56) References Cited

U.S. PATENT DOCUMENTS 3,750,500 A 8/1973 Peterson
3,835,489 A 9/1974 Lagace et al.
(Continued)

FOREIGN PATENT DOCUMENTS

DE 2633037 A1 2/1977
FR 2333917 A1 7/1977
(Continued)

OTHER PUBLICATIONS

International Search Report and Written Opinion of the International Searching Authority of corresponding PCT application PCT/US2015/070757 dated Jan. 22, 2016.

*Primary Examiner* — Lee D Wilson
(74) *Attorney, Agent, or Firm* — Edell, Shapiro & Finnan, LLC

(57) ABSTRACT

According to one embodiment an extractor is provided that comprises a stem with a handle at one end and a conical spacer engagement device cooperating with the conical spacer for extracting it from the concrete wall at the other end. The extractor also comprises a mobile element which is displaceable by a user along the stem between a retracted position to which the mobile element is moved in order to contribute to the extraction of the conical spacer, and an advanced position to which the mobile element is moved in order to push the conical spacer, releasing it from the conical spacer engagement device. When the conical spacer engagement device is fixed to the conical spacer, then the mobile element is moved to the retracted position, the corresponding conical spacer being extracted. The mobile element is then moved again to the advanced position, releasing the conical spacer from the conical spacer engagement device.

19 Claims, 4 Drawing Sheets

(56) References Cited

U.S. PATENT DOCUMENTS

| | | | | |
|---|---|---|---|---|
| 4,109,893 | A | 8/1978 | Laroche | |
| D272,712 | S * | 2/1984 | Allen | D8/75 |
| 4,476,861 | A * | 10/1984 | Dimakos | A61B 17/92 606/100 |
| 5,813,185 | A | 9/1998 | Jackson | |
| 8,166,624 | B2 * | 5/2012 | Andreasen | B25B 31/00 29/254 |
| 8,407,874 | B2 * | 4/2013 | Giberti | B25F 1/003 29/254 |
| 2018/0230702 | A1 * | 8/2018 | Elduayen Madariaga | E04G 17/0642 |

FOREIGN PATENT DOCUMENTS

| | | | |
|---|---|---|---|
| JP | 2000345705 | A | 12/2000 |
| JP | 2012046973 | A | 3/2012 |
| JP | 3182061 | U | 3/2013 |
| JP | 3184037 | U | 6/2013 |
| JP | 5748167 | B1 | 7/2015 |
| WO | 2006107401 | A2 | 10/2006 |

* cited by examiner

EXTRACTOR FOR EXTRACTING CONICAL SPACERS IN CONCRETE WALLS OR PILLARS AND ASSOCIATED METHOD

CROSS-REFERENCE TO RELATED APPLICATIONS

This application relates to and claims the benefit and priority to International Application No. PCT/ES2015/070757, filed Oct. 20, 2015.

TECHNICAL FIELD

The present invention relates to conical spacers used in concrete formworks for building concrete walls or pillars, and more specifically to tools for extracting the spacers from the concrete once it is set.

BACKGROUND

Concrete walls or pillars are usually made on site providing a gap between two formwork panels that are arranged such that they are facing one another. Said panels are secured to one another by means of transverse tie bolts which traverse said panels. The ends of the bolts project from the panels and are threaded to allow placing the corresponding nuts.

Once the panels are secured, concrete is poured into the gap which is arranged sandwiched between the formwork panels. To prevent the concrete from adhering to the transverse tie rods once it sets, said tie rods are usually covered by or placed inside a PVC tube. Conical spacers, also usually made of PVC, are placed at the ends of the tube and are supported against the inner face of the corresponding formwork panel. Once the concrete sets, the formwork panels and the transverse tie rods are disassembled and the conical spacers are extracted. A hammer and a chisel are normally used to extract the conical spacers.

The extraction of the tube is optional and largely depends on the application of the wall. For example, in concrete walls intended for containing a fluid, where correct sealing of the wall is very important, such as for example water tanks, swimming pools, lubricant tanks, etc., it is suitable to extract said tube for assuring the leak-tightness of the wall.

When the tie rods are disassembled they provide through holes in the concrete wall that must be closed and sealed to prevent water seepage in the wall.

The formwork process for the wall of a building, a retaining wall of a dam or that of a pillar is similar.

U.S. Pat. No. 5,813,185A discloses a cylindrical tube internally housing a transverse tie rod that is used to secure two formwork panels arranged parallel facing one to another. A conical spacer is detachably coupled at each end of the tube. The ends of the transverse tie rods are threaded, each end being attached to a conical spacer by the inner face thereof. An additional bolt is screwed to each conical spacer such that it projects from the corresponding formwork panel. Once the concrete sets, the additional bolts are extracted and the corresponding formwork panels are disassembled. A hex key is used to extract the conical spacers, such that when the hex key is turned, it causes the spacer to turn, thereby unscrewing it from the transverse tie rod. The conical spacers described in U.S. Pat. No. 5,813,185A comprise a hexagonal recess which makes it easier to insert the hex key.

SUMMARY OF THE DISCLOSURE

An extractor for extracting conical spacers is provided that comprises a stem and a handle arranged at one end of the stem. At the other end, the stem comprises a conical spacer engagement device cooperating with the conical spacer for extracting said conical spacer. The extractor also comprises a mobile element which is displaceable by the user along the stem between a retracted position to which said mobile element is moved in order to contribute to the extraction of the conical spacer of the concrete wall or pillar, and an advanced position to which the mobile element is moved in order to push the conical spacer for releasing it from the conical spacer engagement device of the stem.

In an initial coupling step, the conical spacer engagement device is fixed to the conical spacer, then in an extraction step the mobile element is moved, preferably manually, to the retracted position, the corresponding conical spacer being extracted, and finally the mobile element is moved again, preferably manually, in an expulsion step to the advanced position, releasing the conical spacer from the conical spacer engagement device.

With the extractor and the method disclosed conical spacers are extracted from a concrete wall or pillar in a simple, quick and effective manner, without damaging the concrete wall, which entails a significant time savings in building the concrete wall. The conical spacers extracted with the tool and the method of the invention can be used again because they deteriorate very little during the extraction process, and are released from the extractor in a simple, quick and effective manner.

These and other advantages and features will become evident in view of the drawings and the detailed description.

DETAILED DESCRIPTION

Figure 2:
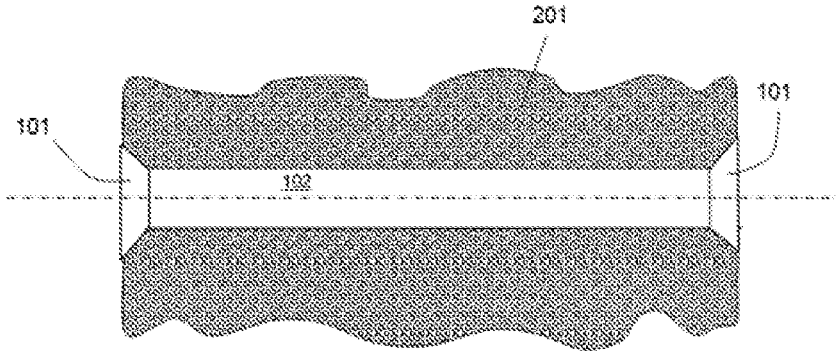
Prior art Fig. 2
FIG. 2 shows a schematic view of a portion of a concrete wall obtained by the assembly process of FIG. 1 where neither the protective tube nor the conical spacers has been extracted.

When building a wall 201 such as the one shown schematically as an example in FIG. 2, a plurality of formwork panels 103 is usually required and a plurality of tie rods 105 and conical spacers 101 (the tube 102 is optional) is required for each pair of formwork panels 103 to keep said formwork panels 103 attached to one another. Therefore, the extraction of the conical spacers 101 can delay execution of the work if it is not done quickly enough.

Figure 1:
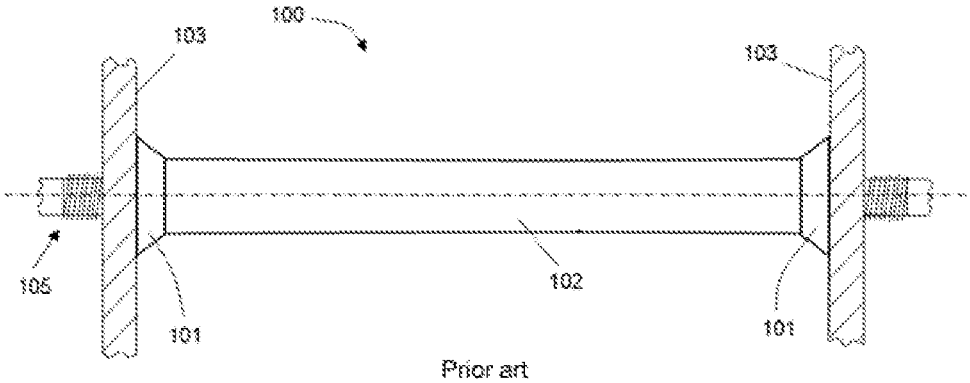
Prior art Fig. 1
FIG. 1 schematically shows a section of the assembly of formwork panels of the prior art that incorporate conical spacers and a protective tube.

FIG. 1 shows an example of the assembly required for placing said formwork panels 103, and FIG. 2 shows schematically a portion of the obtained concrete wall 201 where neither the protective tube 102 nor the conical spacers 101 have been extracted yet.

Figure 3:
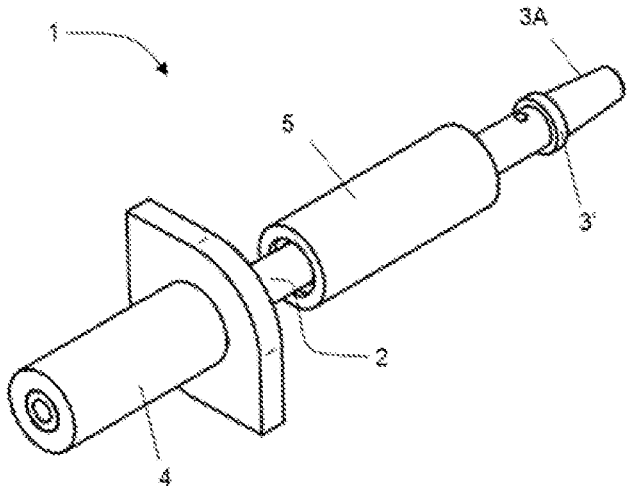
FIG. 3 shows a perspective view of the extractor for extracting conical spacers according to an embodiment.

FIG. 3 shows an extractor 1 for extracting conical spacers 101 according to one embodiment. Said extractor 1 comprises a stem 2 and a handle 4 arranged at one end of the stem 2. At the other end, the stem 2 comprises a conical spacer engagement device 3A cooperating with the conical spacer 101 for extracting said conical spacer 101. The extractor 1 also comprises a mobile element 5 which is displaceable by the user along the stem 2 between a retracted position to which said mobile element 5 is moved in order to contribute to the extraction of the conical spacer 101 from the concrete wall or pillar 201, and an advanced position to which the mobile element 5 is moved in order to push the conical spacer 101 for releasing it from the conical spacer engagement device 3A of the stem 2.

For the sake of establishing a longitudinal orientation of the components of the extractor 1 as recited in the claims, the handle 4 is considered to reside at a proximal end of the extractor and the conical spacer engagement device is considered to reside at a distal end of the extractor.

The extractor 1 significantly reduces the time required for extracting conical spacers 101, making the extraction of said conical spacers 101 a simple, effective and quick operation to perform. The concrete wall 201 is not damaged with the extractor 1, and therefore the subsequent sealing of the corresponding holes, required in some applications, such as in a retaining wall of a dam, etc., is more effective.

The conical spacers 101 extracted with the extractor 1 can be reused because they deteriorate very little during the extraction process, such it contributes to obtain considerable savings in construction material.

Figure 5:
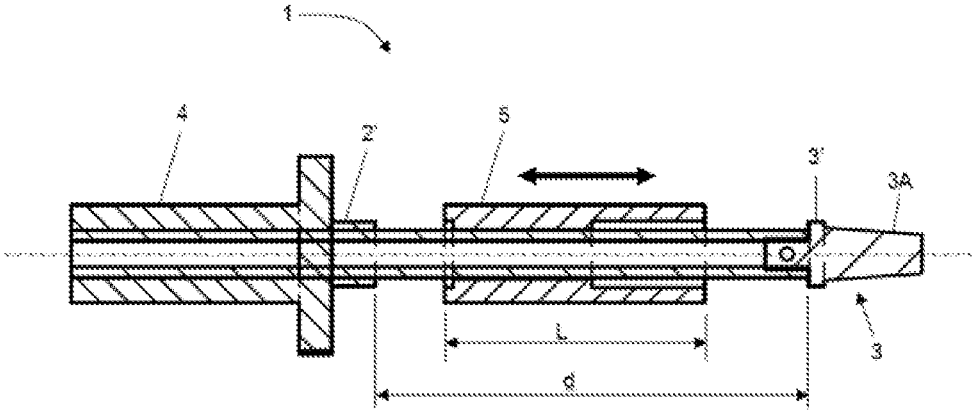
FIG. 5 shows cross-section V-V of FIG. 4.

According to one embodiment, the stem 2 is cylindrical and internally comprises an at least partially threaded through hole. In a non-limiting example of the invention, said inner hole is threaded along the entire length thereof, as shown in FIG. 5, although it is also possible for only the ends to be threaded. These threaded means allow easily fixing the handle 4 at one end of the stem 2.

Figure 4:
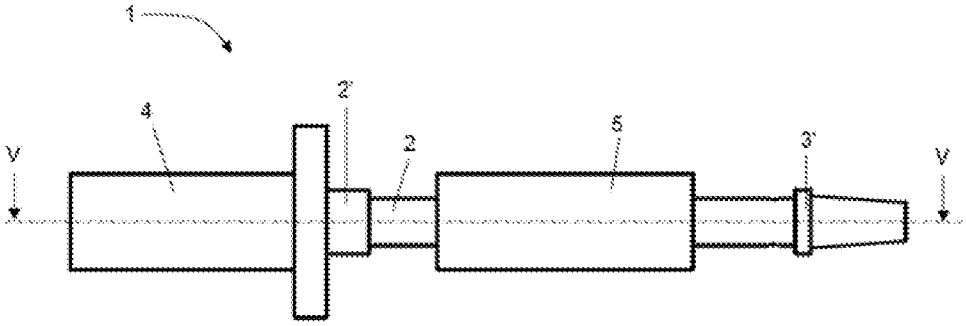
FIG. 4 shows a front view of the extractor for extracting conical spacers of FIG. 3.
Figure 5A:
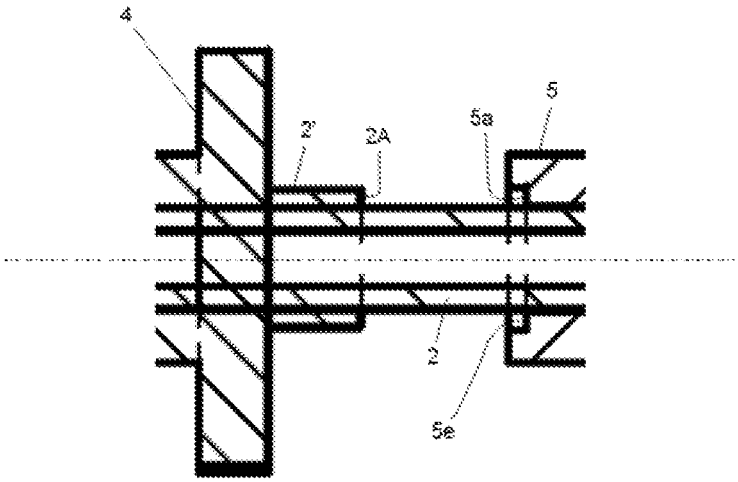
FIG. 5A shows a first detail of the cross-section of FIG. 5.

As shown in FIGS. 4 and 5, and in further detail in FIG. 5A, according to one embodiment the extractor 1 comprises a proximal stop 2' arranged at the end of the stem 2 closest to the handle 4, adjacent to same, comprising a proximal stop surface 2A cooperating in the retracted position with a first stop surface 5*a* comprised in the mobile element 5, as shown in FIG. 5A.

According to one embodiment, said proximal stop 2' is cylindrical and projects radially from the stem 2. The proximal stop 2' may be an integral part of the stem 2, as seen in the drawings, but optionally it could be a separate part fixed to the stem 2 by pressure fitting, through threaded means, or by similar processes.

In a variant not shown in the drawings, the proximal stop 2' could comprise at least two protuberances projecting radially from the stem 2, said protuberances being arranged equidistantly around the outer circumference of the stem 2.

According to one embodiment, the mobile element 5 is cylindrical and internally comprises a through hole which is traversed by the stem 2, as shown in FIG. 5, such that the mobile element 5 is allowed to slide along the stem 2.

The first stop surface 5*a* of the mobile element 5 is arranged at one end of the mobile element 5, logically at the end arranged closest to the proximal stop 2'. Preferably, said first stop surface 5*a* is arranged at the bottom of a recess 5*e*, as shown in the detail of FIG. 5A, such that the mobile element 5, being in the retracted position, covers at least part of the proximal stop 2'.

Figure 5B:
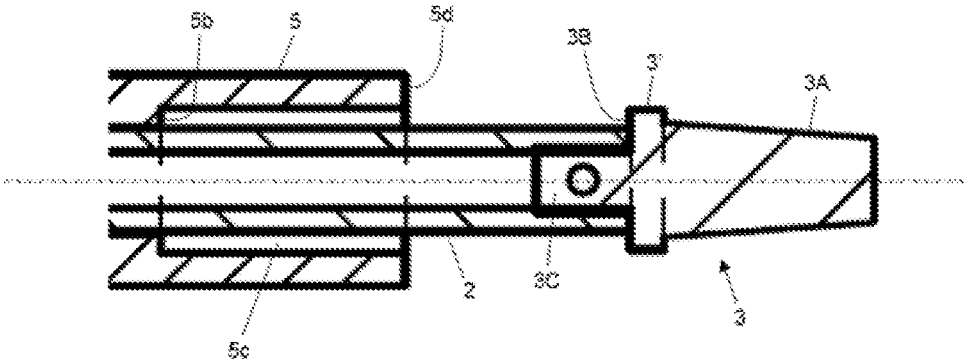
FIG. 5B shows a second detail of the cross-section of FIG. 5.

According to one embodiment, the extractor 1 comprises distal stop 3' arranged at the end of the stem 2 next to the conical spacer engagement device 3A. Said distal stop 3' comprises a distal stop surface 3B cooperating in the advanced position with a second stop surface 5*b* comprised in the mobile element 5, as shown in FIG. 5B.

Like the proximal stop 2', said distal stop 3' may be cylindrical and projects radially from the stem 2, being arranged adjacent to the conical spacer engagement device 3A. The distal stop 3' and the conical spacer engagement device 3A form a detachable active end 3 that is fixed to the free end of the stem 2 by non-permanent attachment means, for example threaded means. This configuration allows the simple and quick insertion, and extraction when required, of the stem 2 in the mobile element 5. To make assembly of the active end 3 easier, according to one embodiment said active end 3 comprises a threaded protuberance 3C at the end opposite the conical spacer engagement device 3A, as seen in FIG. 5B. Optionally, said non-permanent attachment means can comprise a pin.

To assemble the mobile element 5 on the stem 2, the active end 3 must first be disassembled and once the mobile element 5 is assembled, the active end 3 is fixed to the stem 2 again. The mobile element 5 is thereby trapped between the two stops 2' and 3', the conical spacer engagement device 3A being arranged outside the area delimited by both stops 2' and 3'. The distance "d" between these two stops 2' and 3' is greater than the length "L" of the mobile element 5, therefore the mobile element 5 can move between these two stops 2' and 3'.

In one variant not shown in the drawings, the active end 3 is not detachable and can be fixed to the end of the stem 2 by other means, such as welding, or it can be configured such that it is an integral part of the stem 2. In this variant, the handle 4 and the proximal stop 2' will be detachable to allow the insertion, and extraction when required, of the mobile element 5, by proceeding in a manner similar to that described in the preceding paragraph.

Optionally, in another embodiment not shown in the drawings, the distal stop 3' could comprise at least two protuberances that project radially from the stem 2, said protuberances being arranged equidistantly around the outer circumference of the stem 2.

The second stop surface 5*b* of the mobile element 5 is arranged at the other end of the mobile element 5, i.e., at the end arranged closest to the distal stop 3'. Preferably, said second stop surface 5*b* is arranged at the bottom of an internal recess 5*c*, as shown in the detail of FIG. 5B, such that the mobile element 5 covers the distal stop 3' and at least part of the conical spacer engagement device 3A in the advanced position.

Most conical spacers 101 of the state of the art are made of plastic, preferably PVC, and comprise an inner hole to allow the passage of the transverse tie rod. Said inner hole is threaded in some cases and in others it is not.

According to one embodiment both the stem 2 and the mobile element 5 and the active end 3 are metallic, preferably made of steel, and the length "L" of the mobile element 5 is greater than its diameter, as seen in FIG. 5, although other configurations are not ruled out.

According to one embodiment, the conical spacer engagement device 3A of the extractor 1 is conical, as shown in the drawings, which favors the insertion of said conical spacer engagement device 3A into the inner hole of the corresponding conical spacer 101. Furthermore, said conical configuration enables the conical spacer engagement device 3A to adapt to different diameters, which favors being able to use the extractor 1 in different types of conical spacers, it being unnecessary to adapt the conical spacers of the state of the art to use the extractor 1.

According to one embodiment, the conical spacer engagement device 3A comprises a threaded area, not depicted in the drawings. When said threaded area of the conical spacer engagement device 3A is turned inside the conical spacer 101, the metallic threading generates a small indent inside the corresponding conical spacer 101, both elements being attached to one another. The extractor 1 does not have to penetrate far into the conical spacer 101 in order to cause said attachment.

In a coupling step, the user fixes the extractor 1 to the conical spacer 101 as indicated in the preceding paragraph, i.e., the extractor 1 is turned manually in the inner hole of the conical spacer 101 while the user keeps the extractor 1 upright by the handle 4 in order to make the small indent in the conical spacer 101 if the latter is not previously threaded.

Then in an extraction step, the user moves the mobile element 5 manually to the retracted position of the extractor 1 such that the mobile element 5 hits against the proximal stop 2'. Due to the action and reaction forces that are generated, the extractor 1 pulls on the conical spacer 101, extracting it from the concrete wall 201 in a simple, quick and almost effortlessly manner. The extraction of the conical spacer 101 is clean, i.e., no cracks are formed in the concrete 201 around the corresponding conical spacer 101, as may occur in the case of using a hammer and chisel.

Since the stem is straight, the mobile element 5 follows a linear path.

Finally, in an expulsion step, the mobile element 5 of the extractor 1 is moved manually to the advanced position of the extractor 1, or to a position close to it, where the mobile element 5 pushes the conical spacer 101, quickly and effortlessly releasing it from the conical spacer engagement device 3A of the extractor 1. To that end, the mobile element 5 comprises a pushing surface 5*d* that pushes the corresponding conical spacer 101 out of the conical spacer engagement device 3A.

As is evident in view of the detailed description, the time for extracting conical spacers 101 from a concrete wall or pillar is drastically reduced, this method of extraction being safer than most of the methods used in the prior art.

The small indent caused by the conical spacer engagement device 3A scarcely damages the conical spacer 101, so said conical spacers 101 can be used again, once more contributing to obtaining significant savings in construction material.

The outer surface of the mobile element 5 may be knurled to make handling thereof easier.

What is claimed is:

1. An extractor for extracting a spacer from a concrete wall, the extractor comprising:

a stem having at a proximal end a handle and at a distal end a spacer engagement device, the spacer engagement device being configured to connect with the spacer;

a mobile element positioned about and slidable on the stem between the handle and the spacer engagement device, the mobile element moveable between a retracted position to which the mobile element is moved in order to apply a proximally applied force to the spacer engagement device to contribute to the extraction of the spacer from the concrete wall, and an advanced position to which the mobile element is moved in order to apply a distally applied force to push and release the spacer from the conical spacer engagement device;

the stem including a proximal stop having a proximal stop surface and a distal stop having a distal stop surface, the mobile element being slidable between the proximal and distal stop surfaces of the stem, the mobile element having a proximal stop surface that is configured to engage with the proximal stop surface of the stem when the mobile element is in the retracted position;

the mobile element including a distal stop surface that is configured to engage with the distal stop surface of the stem when the mobile element is in the advanced position;

the proximal stop surface of the mobile element residing inside a proximal recess of the mobile element.

2. The extractor according to claim 1, wherein the spacer engagement device is arranged distally adjacent the distal stop of the stem.

3. The extractor according to claim 1, wherein the distal stop surface of the stem forms a part of the spacer engagement device.

4. The extractor according to claim 1, wherein when the mobile element is in the advanced position, at least a portion of the spacer engagement device resides inside the distal recess.

5. The extractor according to claim 1, wherein at least one of the handle and spacer engagement device is coupled to the stem by threaded engagement.

6. The extractor according to claim 1, wherein each of the proximal and distal stops of the stem is cylindrical and projects radially from the stem.

7. The extractor according to claim 1, wherein the mobile element is cylindrical and internally comprises a through hole which is traversed by the stem.

8. The extractor according to claim 1, wherein the mobile element has a length dimension and a diameter dimension, the length dimension being greater than the diameter dimension.

9. The extractor according to claim 1, wherein the spacer engagement device comprises an external surface that includes a threaded region that is configured to connect the spacer engagement device to the spacer.

10. The extractor according to claim 1, wherein an outer surface of the mobile element is knurled.

11. An extractor for extracting a spacer from a concrete wall, the extractor comprising:

a stem having at a proximal end a handle and at a distal end a spacer engagement device, the spacer engagement device being configured to connect with the spacer;

a mobile element positioned about and slidable on the stem between the handle and the spacer engagement device, the mobile element moveable between a retracted position to which the mobile element is moved in order to apply a proximally applied force to the spacer engagement device to contribute to the extraction of the spacer from the concrete wall, and an advanced position to which the mobile element is moved in order to apply a distally applied force to push and release the spacer from the conical spacer engagement device;

the stem including a proximal stop having a proximal stop surface and a distal stop having a distal stop surface, the mobile element being slidable between the proximal and distal stop surfaces of the stem, the mobile element having a proximal stop surface that is configured to engage with the proximal stop surface of the stem when the mobile element is in the retracted position;

the mobile element including a distal stop surface that is configured to engage with the distal stop surface of the stem when the mobile element is in the advanced position;

the distal stop surface of the mobile element residing inside a distal recess of the mobile element.

12. The extractor according to claim 11, wherein the spacer engagement device is arranged distally adjacent the distal stop of the stem.

13. The extractor according to claim 11, wherein the distal stop surface of the stem forms a part of the spacer engagement device.

14. The extractor according to claim 11, wherein at least one of the handle and spacer engagement device is coupled to the stem by threaded engagement.

15. The extractor according to claim 11, wherein each of the proximal and distal stops of the stem is cylindrical and projects radially from the stem.

16. The extractor according to claim 11, wherein the mobile element is cylindrical and internally comprises a through hole which is traversed by the stem.

17. The extractor according to claim 11, wherein the mobile element has a length dimension and a diameter dimension, the length dimension being greater than the diameter dimension.

18. The extractor according to claim 11, wherein the spacer engagement device comprises an external surface that includes a threaded region that is configured to connect the spacer engagement device to the spacer.

19. The extractor according to claim 11, wherein an outer surface of the mobile element is knurled.

* * * * *